US008127688B2

(12) United States Patent
Carifa

(10) Patent No.: US 8,127,688 B2
(45) Date of Patent: Mar. 6, 2012

(54) DUAL STAGE RAILROAD HOPPER CAR DOOR ACTUATING MECHANISM

(75) Inventor: Mark Carifa, Pickerington, OH (US)

(73) Assignee: D.A. International Casting, Inc., Mansfield, OH (US)

( * ) Notice: Subject to any disclaimer, the term of this patent is extended or adjusted under 35 U.S.C. 154(b) by 0 days.

(21) Appl. No.: 12/708,595

(22) Filed: Feb. 19, 2010

(65) Prior Publication Data

US 2010/0251925 A1 Oct. 7, 2010

Related U.S. Application Data

(60) Provisional application No. 61/166,869, filed on Apr. 6, 2009.

(51) Int. Cl.
*B61D 7/00* (2006.01)

(52) U.S. Cl. ..... 105/308.1; 105/308.2; 105/253; 105/310.1

(58) Field of Classification Search ..... 105/247, 105/248, 253, 284, 286, 288, 296, 298, 299, 105/308.1, 308.2, 309, 313, 311.1
See application file for complete search history.

(56) References Cited

U.S. PATENT DOCUMENTS 3,240,165 A * 3/1966 Floehr ..... 105/310.1
3,994,238 A * 11/1976 Adler ..... 105/241.2
4,119,041 A * 10/1978 Hipp ..... 105/310.1

* cited by examiner

*Primary Examiner* — Mark Le
(74) *Attorney, Agent, or Firm* — Mueller Law, LLC; Jerry K. Mueller, Jr.

(57) ABSTRACT

A mechanism for controlling opening of doors on a hopper car underside. The mechanism includes a pair of stationary hook assemblies located outboard of a discharge opening and having a proximal end affixed to the hopper car and a distal free end. Each hook assembly includes a locking cavity bounded by a cam locking surface and a distal slide surface. Included also is a pair of locking cam assemblies having an upper and lower cam surface matable with the hook cam locking assembly and having a slot. An elongate member has ends affixed to the pair of locking cam assemblies and extends through each of the annular end bearings. A pair of annular end bearings is disposed adjacent to the locking cam assemblies and each affixed to a door.

6 Claims, 8 Drawing Sheets

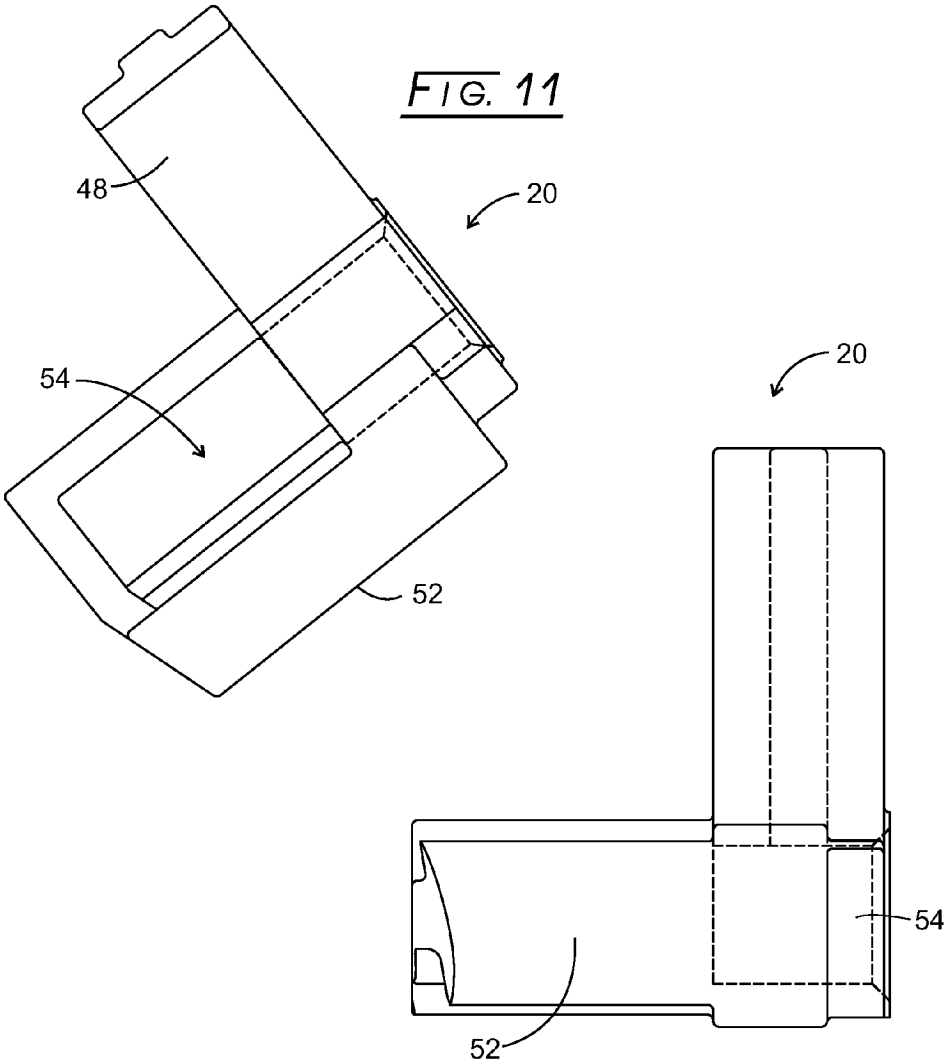
FIG. 11
FIG. 9
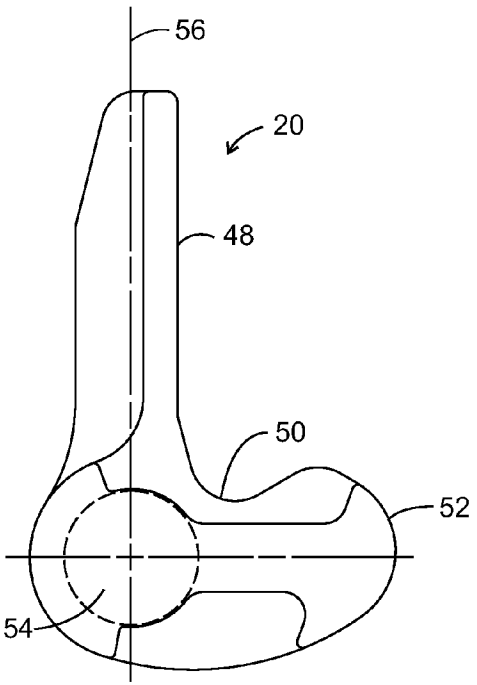
FIG. 10

DUAL STAGE RAILROAD HOPPER CAR DOOR ACTUATING MECHANISM

CROSS-REFERENCE TO RELATED APPLICATIONS

This application claims benefit of priority of provisional application Ser. No. 61/166,869, filed on Apr. 6, 2009, the disclosure of which is expressly incorporated herein by reference.

STATEMENT REGARDING FEDERALLY SPONSORED RESEARCH

Not applicable.

BACKGROUND

The present invention relates generally to an apparatus for opening the doors of a railroad hopper car, and, in particular, to a novel apparatus for manually opening the hopper doors on a railroad car.

A common type of railroad freight car in use today is a freight car of the type wherein the load is discharged through hoppers in the underside of the body. Such cars generally are referred to as "hopper cars" and are used to haul coal, phosphate, and other commodities. After hopper cars are spotted over an unloading pit, the doors of the hoppers are opened, allowing the material within the hopper to be emptied into the pit.

Hopper cars, which may be covered, usually are found with one of two hopper configurations: transverse, in which the doors closing the hoppers are oriented perpendicular to the center line of the car; or longitudinal, in which the doors closing the hoppers are oriented parallel to the center line of the car. An example of a hopper car with transverse doors is shown in U.S. Pat. No. 5,249,531, while an example of a hopper car with longitudinal doors is shown in U.S. Pat. No. 4,224,877.

Hopper cars, having a pair of transverse doors (transverse to the longitudinal axis or centerline of the hopper car), generally are located on either side of the longitudinal centerline of the hopper car. Traditionally, these doors have separately operated doors, requiring the operator to open each separately. To do so, the operator must cross to the opposite side of the track, which places the operator in peril unnecessarily. It also requires each door to be separately opened and closed, which takes additional time. Safety can dictate that an operator be assigned to each side of the hopper car for opening/closing each underside door individually, adding additional cost.

It is to such disadvantages that the disclosure is aimed.

BRIEF SUMMARY

A mechanism for controlling the opening and closing of a pair of doors covering the discharge openings located on the underside of a hopper car underside. Each opening is spaced apart of either side of a longitudinal centerline of a railroad hopper car. Each underside is opening covered with a pivotally hinged door generally pivoted transverse to the hopper car centerline. The mechanism includes a pair of stationary hook assemblies, each being located outboard of a discharge opening and having a proximal end affixed to the hopper car and a distal free end. Each hook assembly includes a locking cavity bounded by a locking cam surface. The stationary hook distal end has a distal slide surface. The mechanism also includes a pair of locking cam assemblies, each having an upper and lower cam surface matable with the hook locking cam surface. Each locking cam assembly also has a slot. An elongate member has ends affixed to the pair of locking cam assemblies. A pair of annular end bearings is disposed adjacent to the locking cam assemblies and each affixed to a door. The elongate member extends through each of the annular end bearings.

Each door is openable by an operator placing an elongate rod into one of the locking cam assembly slots and rotating the locking cam assembly to partially open said door. The operator then rotates the cam lock assembly again with the elongate rod so that the cam lock assembly rotates over the hook assembly locking cam surface to separate the locking cam assembly from the stationary hook assembly and open the door. The operator can access either of the mechanisms to open both doors. The non-accessed mechanism becomes a "slave" to the mechanism being engaged by the operator.

BRIEF DESCRIPTION OF THE DRAWINGS

For a fuller understanding of the nature and advantages of the present apparatus, reference should be had to the following detailed description taken in connection with the accompanying drawings, in which:

FIG. 9 is a plan view of a locking cam assembly;

FIG. 10 is a side view of the locking cam assembly of FIG. 9;

FIG. 11 is a top view of the locking cam assembly of FIG. 9;

The drawings will be described in further detail below.

DETAILED DESCRIPTION

Figure 1:
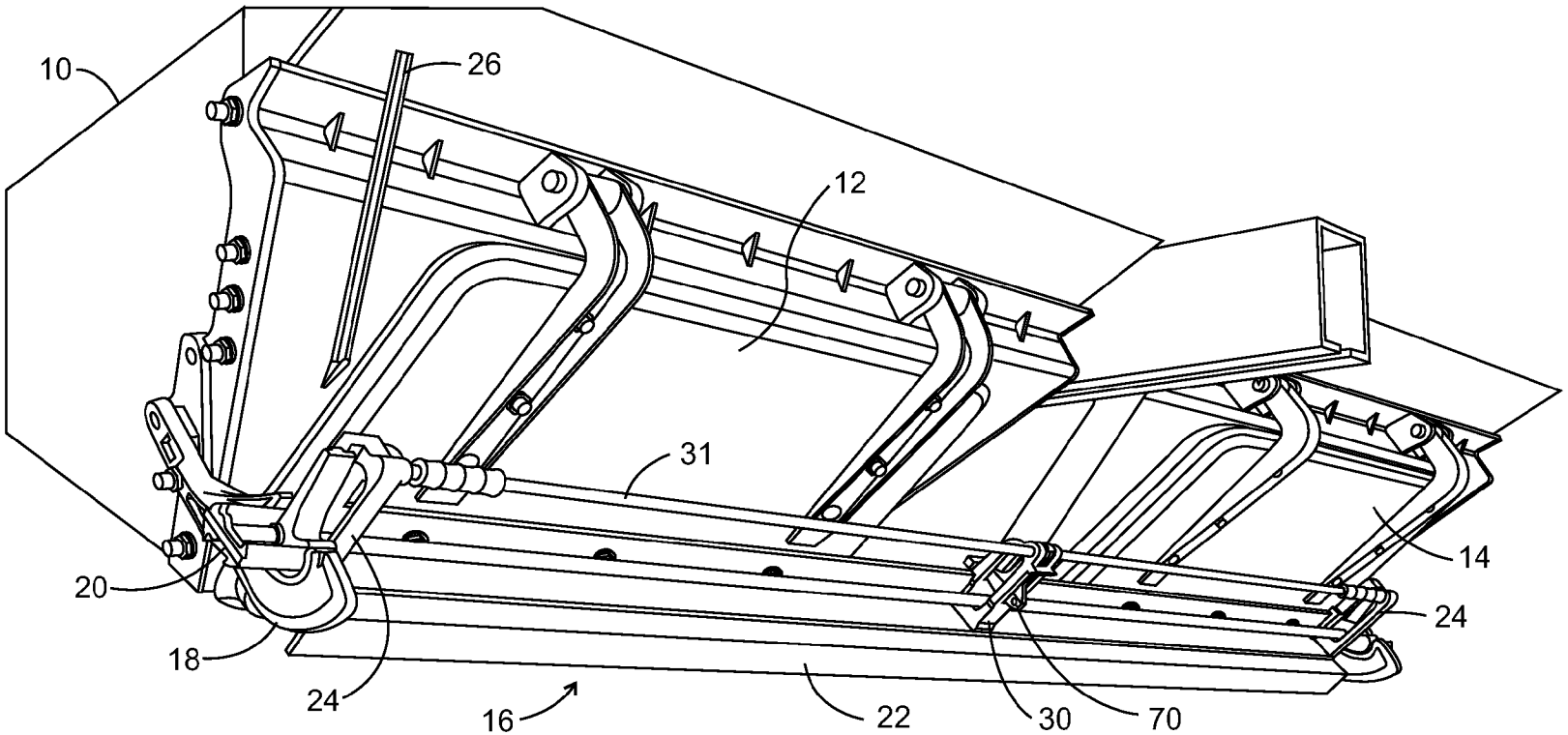
FIG. 1 is an isometric view of the disclosed mechanism shown in a locked state with the hopper car doors in a closed position.
Figure 2:
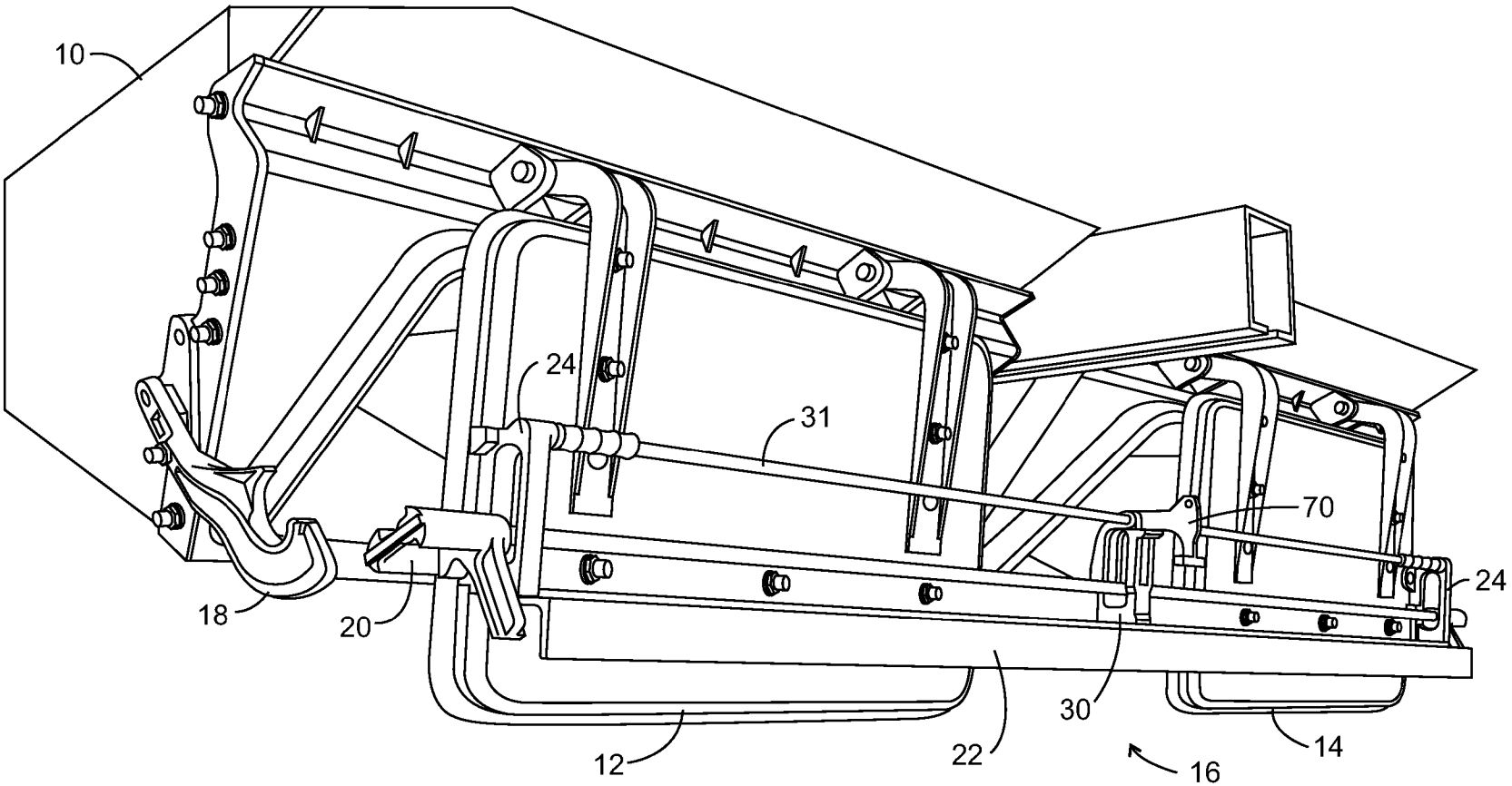
FIG. 2 is an isometric view of the disclosed mechanism in an unlocked state with the hopper doors in an open (unloading) position.

A partial view of the lower side of a railroad hopper car, 10, is seen in FIGS. 1 and 2 with a pair of pivotally-attached doors, 12 and 14, covering openings (see FIG. 2) for unloading or coal or the like from hopper car 10. The disclosed opening/closing door mechanism, 16, has opening/closing locking assemblies at either end that control opening/closing of doors 12 and 14. The locking assemblies are seen in a closed (locked) state with the doors closed in FIG. 1 and in an open (unlocked) state with doors open in FIG. 2. Each locking assembly is composed of a stationary hook assembly, 18; a rotatable locking cam assembly, 20; a rotatable elongate rod, 31; a stationary elongate member, 22, attached to doors 12 and 14; an end bearing assembly, 24; and a hand operated elongate rod, 26, used by an operator to actuate mechanism 16. But for rod 26, each end of mechanism 16 is disposed at either end thereof. Thus, only one end of mechanism 16 will be described, it being understood that a mirror image of the components described herein is disposed at the opposite end of mechanism 16.

Figure 3:
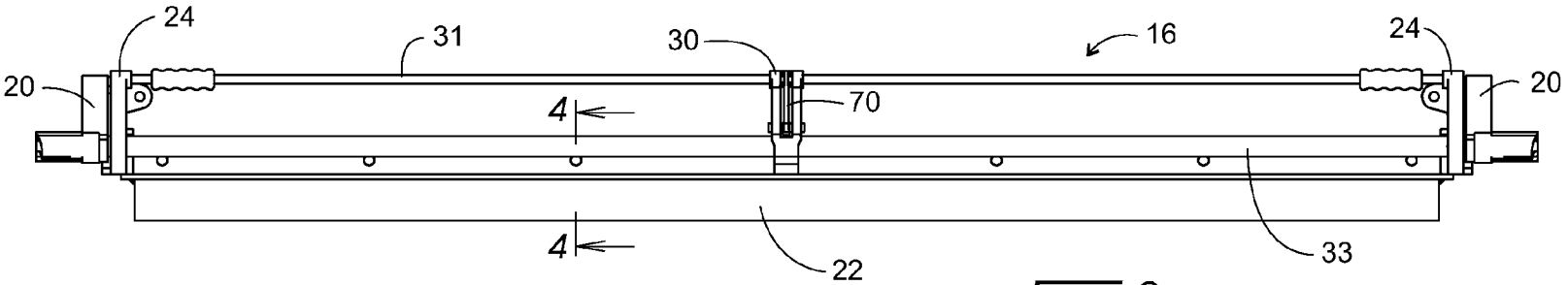
FIG. 3 is a plan view of the disclosed hopper door actuating mechanism.
Figure 4:
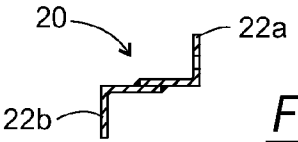
FIG. 4 is a sectional view taken along line 4-4 of FIG. 3.
Figure 5:
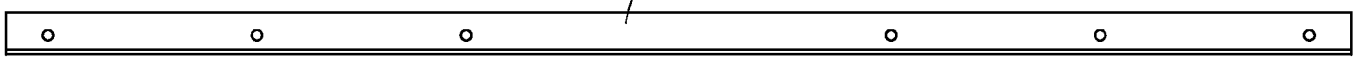
FIG. 5 is a plan view of one angle member.
Figure 6:
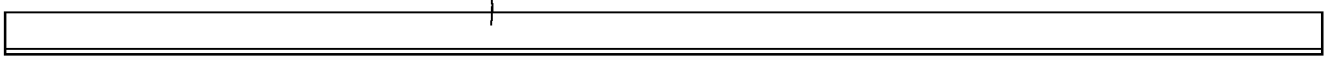
FIG. 6 is a plan view of a second elongate angle member, where the angles of FIGS. 5 and 6 are joined to form the elongate member of the disclosed mechanism.

The components of mechanism 16 also are shown in FIG. 3 in plan view to include end bearing assemblies 24, a center annular bearing, 30, and an elongate rod, 31. A carriage or coupling member, 22, composed primarily of a pair of welded angle irons, 22*a* and 22*b*, as shown in FIGS. 4, 5 and 6, are affixed to (e.g., by welding or the like) doors 12 and 14. Other shapes, of course, of coupling member 22 could be utilized with equal result, including, for example, a single formed carriage in the shape of welded angle irons 22*a* and 22*b*. An elongate rod, 33, is shown in FIG. 3 extending between the locking cam assemblies described in greater detail below.

Figure 8:
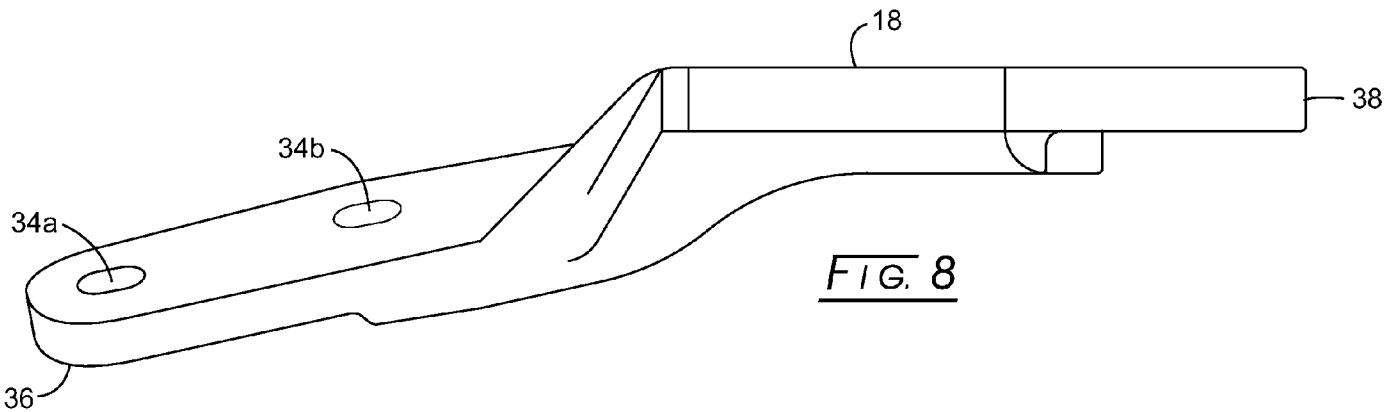
FIG. 8 is a top view of stationary hook assembly of FIG. 7.
Figure 7:
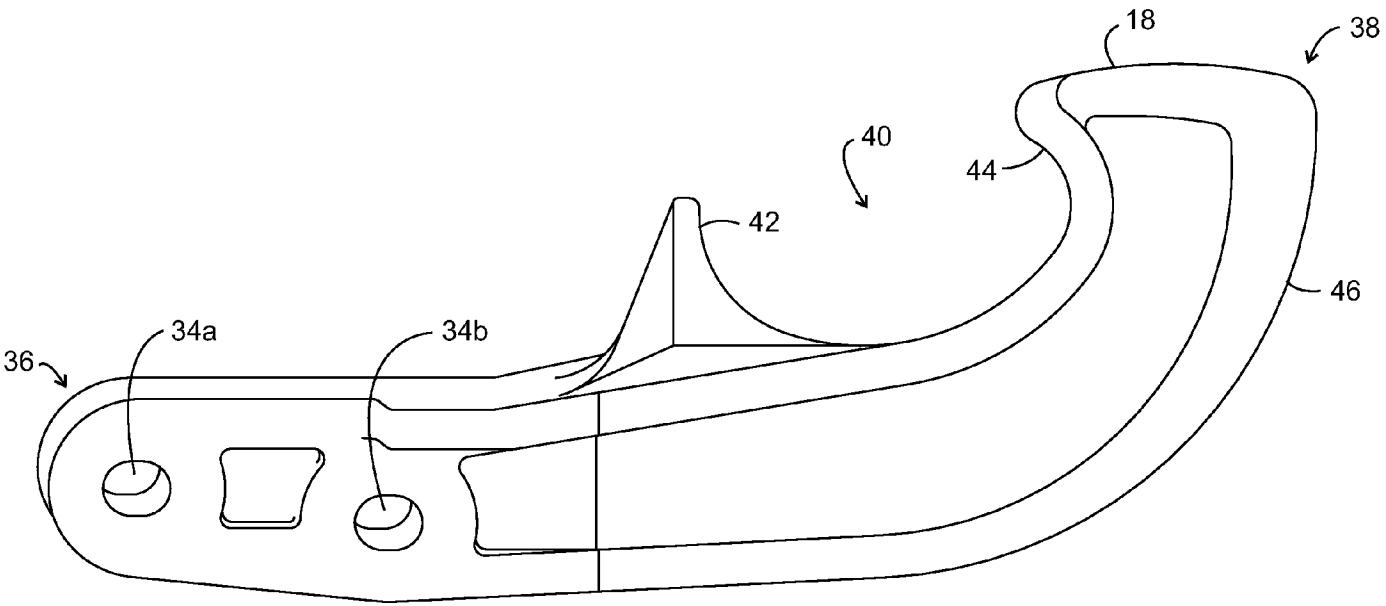
FIG. 7 is a plan view of a stationary hook assembly.

Stationary hook assembly 18 is shown in more detail in FIGS. 7 and 8. Hook assembly 18 is affixed to railcar 10 with bolts (one bolt only being shown in FIG. 1) inserted through holes, 34*a* and 34*b*, located at a proximal end, 36. Disposed closer to a distal end, 38, is a locking cavity, 40, bounded by a tab, 42, and a locking cam surface, 44. Distal end 38 also has an outer surface, 46.

Rotatable locking cam assembly 20 is shown in more detail in FIGS. 9, 10, and 11. Locking cam 20 has an upstanding elongate tab, 48, an upper cam surface, 50, a lower cam surface 52, and a slot, 54, disposed between the cam surfaces. Slot 54 is accessed with elongate rod 26 (see FIG. 1) for actuating cam assembly 20. Upper cam surface 50 is matable with hook cam locking surface 44 and lower cam surface 52 is matable with hook cam locking surface 44. Locking cam assembly 20 has a centerline, 56, whose function will be described below.

Figure 14:
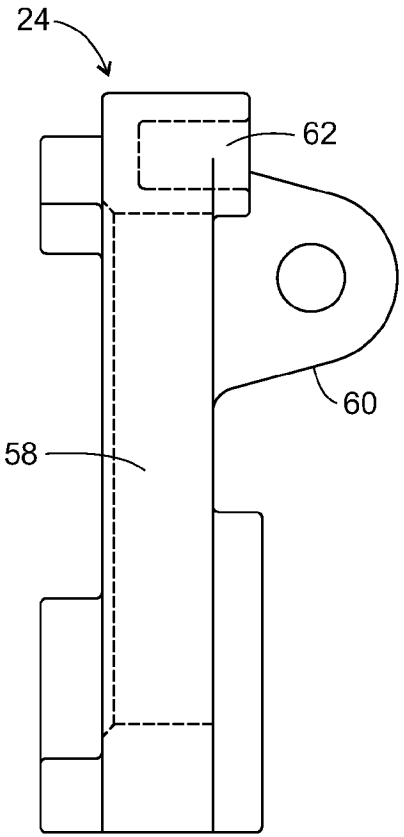
FIG. 14 is the opposite side view of the annular end bearing of FIG. 12.
Figure 12:
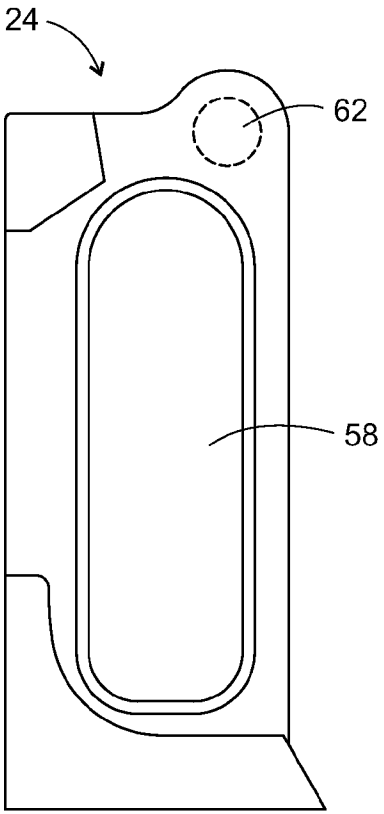
FIG. 12 is a plan view of an annular end bearing.
Figure 13:
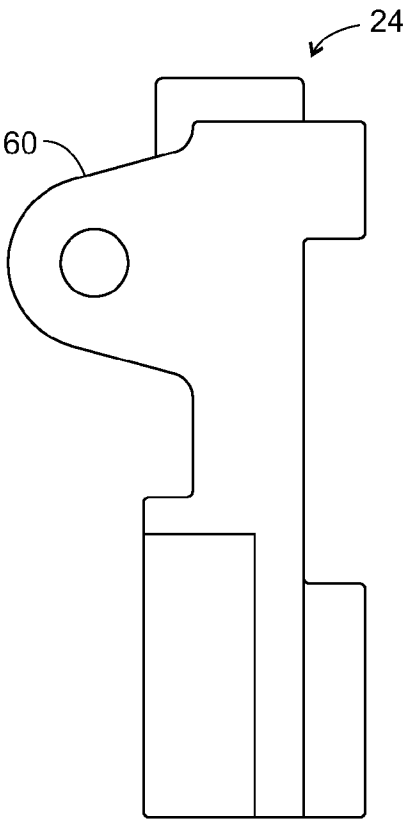
FIG. 13 is a one side-view of the annular end bearing of FIG. 12.
Figure 20:
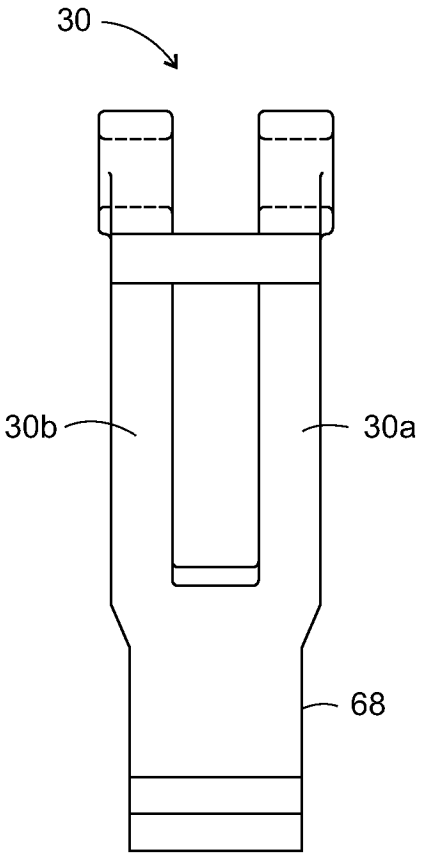
FIG. 20 is the opposite side view of the center bearing of FIG. 18.
Figure 18:
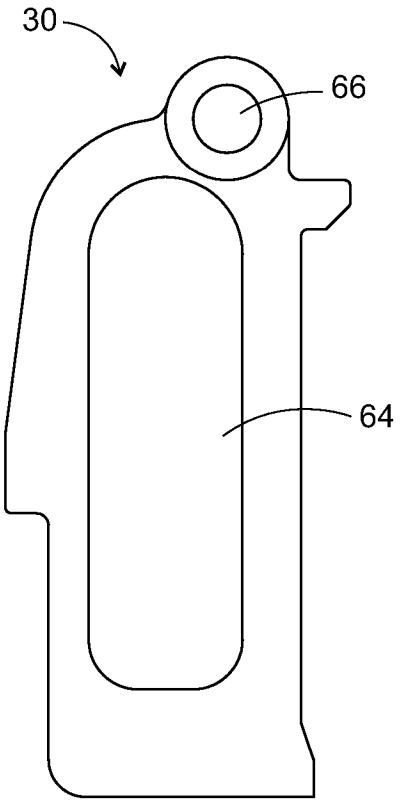
FIG. 18 is a plan view of a center bearing.
Figure 19:
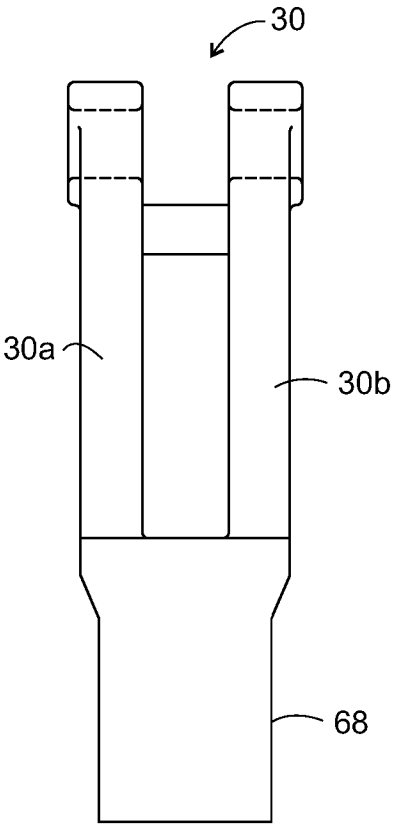
FIG. 19 is one side-view of the center bearing of FIG. 18.

The central bearing assembly 30 is shown in FIGS. 18, 19, and 20, while the end bearing assemblies are shown in FIGS. 12, 13, and 14. The right and left end bearing assemblies are the same, so only one will be described in detail. End bearing assembly 24 is fixed to elongate carriage or coupling member 22 and to door 12 using an apertured tab, 60. End bearing assembly 24 has a cavity or recess, 62, for receiving an end of rod 31, while aperture 66 in central bearing assembly 30 is configured for rod 31 to pass therethrough.

Central bearing assembly 30 is composed of a pair of upstanding apertured legs, 30*a* and 30*b*, and a lower base portion, 68. The apertured pathway 66 accommodates rod 31, as mentioned above. Cavity or slot 64 accommodates elongate rod 33.

Figure 17:
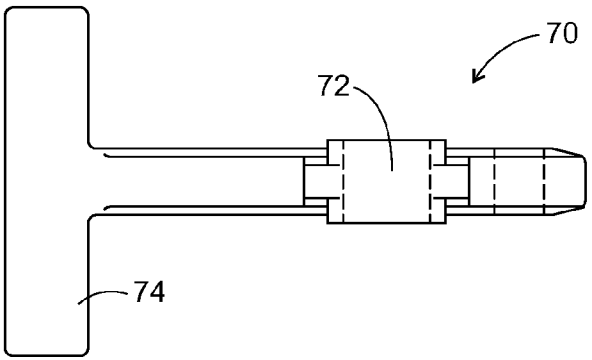
FIG. 17 is the top view of the locking pawl of FIG. 15.
Figure 16:
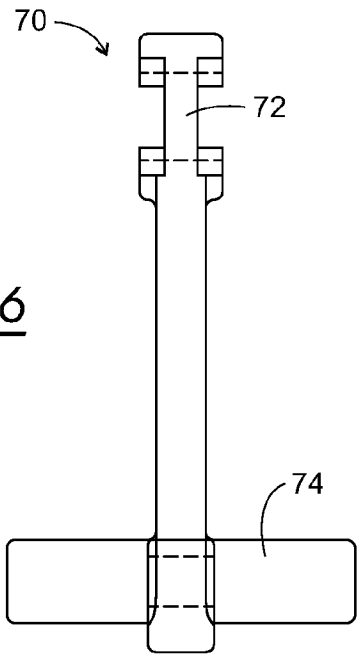
FIG. 16 is one side-view of the locking pawl of FIG. 15.
Figure 15:
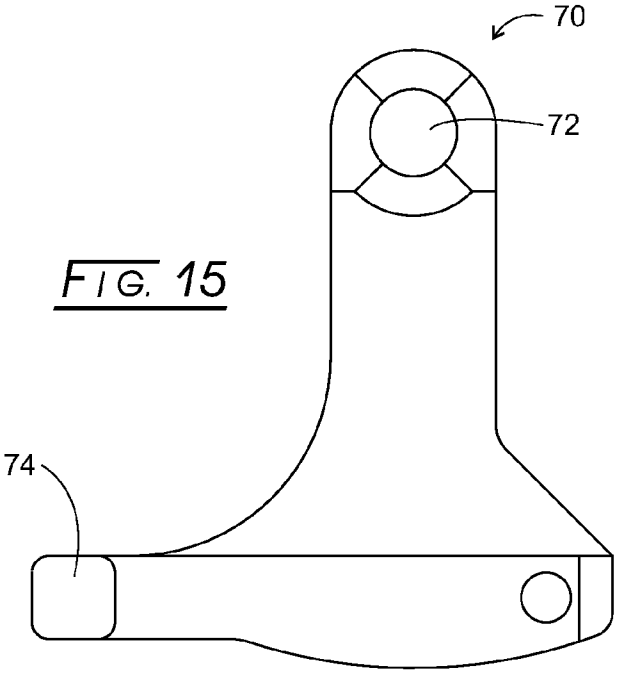
FIG. 15 is plan view of a locking pawl.

A locking pawl, 70, is illustrated in FIGS. 15, 16, and 17. Locking pawl 70 is located between central bearing legs 30*a* and 30*b* with an aperture, 72, having rod 31 placed therethrough to hold locking pawl 70 in place. Locking pawl 70 is fixed to rod 31 and rotatable from a locking position, as shown in FIG. 1, to an unlocked position, as shown in FIG. 2. A transverse member, 74, on one end of locking pawl 70 rotates from its open condition shown in FIG. 2 back towards car 10 to lock in place behind central bearing 30.

In use, the operator grasps elongate rod 26 and places it through locking cam slot 54 and rotates locking cam assembly 20 to partially open discharge doors 12 and 14. This operation releases locking cam assembly lower cam surface 52 from hook cam locking surface 44. The next rotation of locking cam assembly 20 rotates locking cam assembly 20 upper cam surface 50 over hook cam surface 44 to release locking cam assembly 20 from hook 18 and open a discharge door.

To close a discharge door, the operator swings elongate carriage or coupling member 22 (using a foot, for example) until locking cam assembly 20 lower surface 52 moves along hook outer slide surface 18 until locking cam assembly 20 upper cam surface 50 is mated with hook cam surface 44. The discharge door now is partially closed. With the next rotation of locking cam assembly 20 by the operator using elongate rod 26, locking cam assembly 20 lower cam surface 52 now mates with hook locking cam surface 44. Rotation of locking cam assembly 20 is ceased when upstanding elongate tab 48's centerline 56 has rotated beyond vertical, for example, by about 9°. The center of gravity of locking cam assembly is such that any pressure on the discharge door moves locking cam assembly 20 further in the locking state to ensure that the discharge door does not inadvertently open and prematurely discharge its load.

While the apparatus has been described with reference to various embodiments, those skilled in the art will understand that various changes may be made and equivalents may be substituted for elements thereof without departing from the scope and essence of the disclosure. Additionally, many modifications may be made to adapt a particular situation or material to the teachings of the disclosure without departing from the essential scope thereof. Therefore, it is intended that the disclosure may not be limited to the particular embodiments disclosed, but that the disclosure will include all embodiments falling within the scope of the appended claims. In this application the US measurement system is used, unless otherwise expressly indicated. Also, all citations referred to herein are expressly incorporated herein by reference.

I claim:

1. A mechanism for controlling the opening and closing of a pivotally hinged discharge door covering an opening of a hopper car underside discharge opening, said mechanism comprising:

(a) a pair of stationary hook assemblies, each located outboard of a discharge opening and having a proximal end affixed to the hopper car and a distal free end, each hook assembly comprising a locking cavity bounded by a locking cam surface, the stationary hook distal end having a distal slide surface;

(b) a pair of rotatable locking cam assemblies, each having a cam surface matable with the locking cam surface, each locking cam assembly having a slot, each locking cam having an upstanding elongate tab having a centerline, wherein said upstanding elongate tab has a locking position at which the upstanding elongate tab centerline rotates passes a perpendicular position with said locking cam surface and locks said locking cam assembly such that pressure on each said locking cam assembly rotates said upstanding elongate tab further into a locking position;

(c) a rotatable elongate member having ends affixed to said pair of locking cam assemblies; and (d) an end bearing assembly comprising an elongate coupling member terminated at each end with an annular end bearing, each said annular end bearing disposed adjacent to one of said locking cam assemblies and each annular end bearing affixed to said discharge door, said rotatable elongate member extending through each of said annular end bearings, said door openable by an operator placing an elongate rod into one of said locking cam assembly slots and rotating said locking cam assembly to partially open said door; the operator then rotating the cam lock assembly again with elongate rod so that the cam lock assembly rotates over said hook assembly locking cam surface to separate said locking cam assembly from said stationary hook assembly and open the door.

2. The mechanism of claim 1, wherein said hopper car has a pair of said discharge openings and carries a pair of said pivotally hinged discharge doors which cover the discharge openings, each of said openings being spaced apart of either side of a longitudinal centerline of a railroad hopper car, each of said discharge openings covered with one of said a pivotally hinged doors, each of said pivotally hinged discharge doors generally pivoting transverse to the hopper car centerline.

3. The mechanism of claim 2, wherein a central bearing assembly is disposed betweens said discharge doors and is carried by said elongate carriage, said elongate carriage affixed to said discharge doors and carrying said annular end bearing and said central bearing assembly.

4. The mechanism of claim 3, wherein a stationary rod is affixed to each of said end bearings and through said central bearing assembly.

5. The mechanism of claim 4, wherein said central bearing assembly carries a rotatable locking pawl to reversibly lock said mechanism.

6. The mechanism of claim 1, wherein said each of locking cam assemblies upstanding elongate tab centerline is rotated about 9° beyond said perpendicular position with said locking cam surface.

* * * * *